US007726626B2

(12) United States Patent
Akabane

(10) Patent No.: US 7,726,626 B2
(45) Date of Patent: Jun. 1, 2010

(54) DAMPER DEVICE

(75) Inventor: Tokuyuki Akabane, Nagano (JP)

(73) Assignee: Nidec Sankyo Corporation (JP)

( * ) Notice: Subject to any disclaimer, the term of this patent is extended or adjusted under 35 U.S.C. 154(b) by 312 days.

(21) Appl. No.: 11/859,115

(22) Filed: Sep. 21, 2007

(65) Prior Publication Data

US 2008/0072966 A1 Mar. 27, 2008

(30) Foreign Application Priority Data

Sep. 21, 2006 (JP) ..... 2006-256132

(51) Int. Cl.
*F16K 31/04* (2006.01)

(52) U.S. Cl. ..... 251/77; 251/129.11; 251/228; 251/229; 251/298

(58) Field of Classification Search ..... 251/298, 251/228, 229, 77, 129.11–129.13, 129.19, 251/297; 62/408, 187
See application file for complete search history.

(56) References Cited

U.S. PATENT DOCUMENTS 2,504,006 A * 4/1950 Davis ..... 251/82
3,119,594 A * 1/1964 Heggem ..... 251/228
3,334,858 A * 8/1967 Hay ..... 251/228
4,614,092 A * 9/1986 Kim et al. ..... 62/408
5,876,014 A * 3/1999 Noritake et al. ..... 251/129.12
6,336,339 B1 * 1/2002 Joung et al. ..... 62/408
6,877,716 B2 * 4/2005 Noritake ..... 251/129.12
2005/0076670 A1 * 4/2005 Noritake et al. ..... 62/408

FOREIGN PATENT DOCUMENTS

JP 64-48571 3/1989

* cited by examiner

*Primary Examiner*—John Bastianelli
(74) *Attorney, Agent, or Firm*—Cantor Colburn LLP

(57) ABSTRACT

A damper device may include a frame, a baffle turnably supported on the frame, a drive unit for turnably driving the baffle, a first and a second turnable support parts for supporting the baffle on the frame, and a mechanical connecting part between the drive unit and the baffle which is structured at a position apart from a turning center axial line of the baffle. The first and second turnable support parts are structured by using a shaft part made of resin which is formed in one of the baffle and the frame, and a shaft hole which is formed in the other of the baffle and the frame. A passage through which cold air is passed is opened and closed by the baffle.

9 Claims, 5 Drawing Sheets

4,41
32R
30R
2
40R
9R
9L
32L
30L
3
38
42R
42L
43R
43L
40L
410
381
328
90R
90L
30
326
36
35
34
C
A
A'
31
325
453
81R
451
452
45R
810
385
372
371
387R

Fig. 5(a)
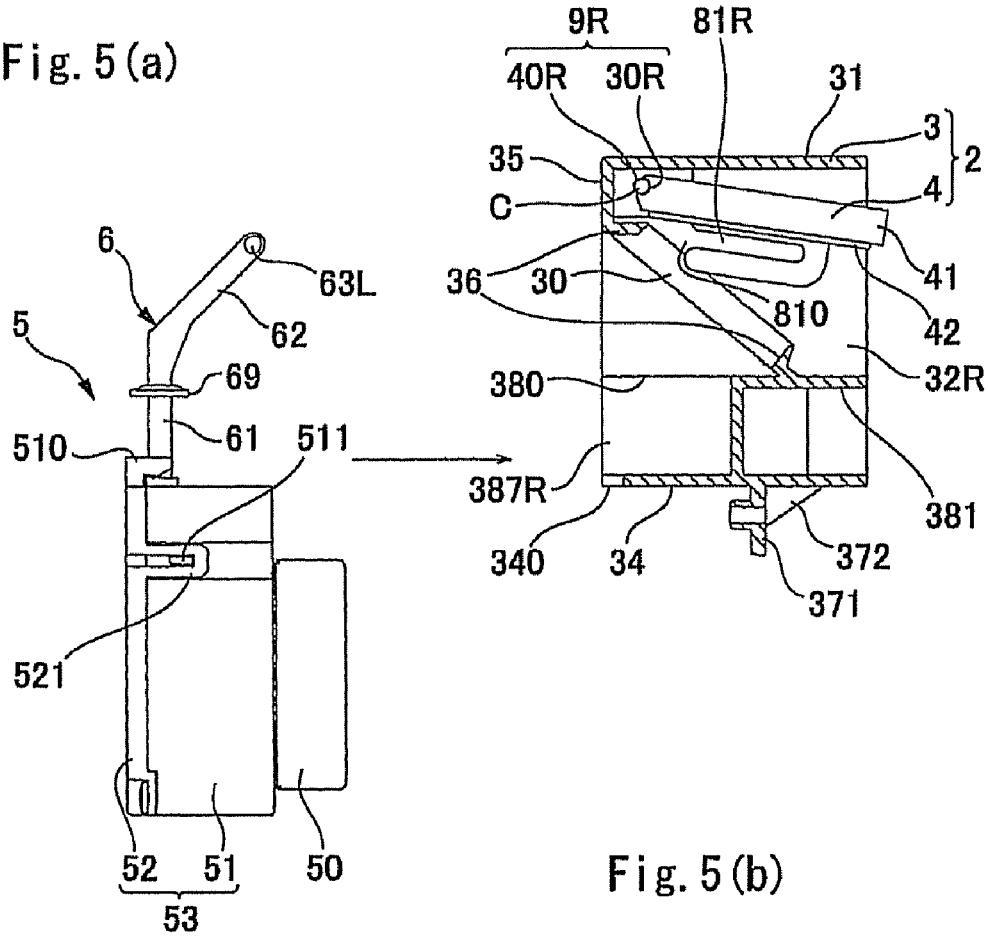
Fig. 5(b)
Fig. 5(c)
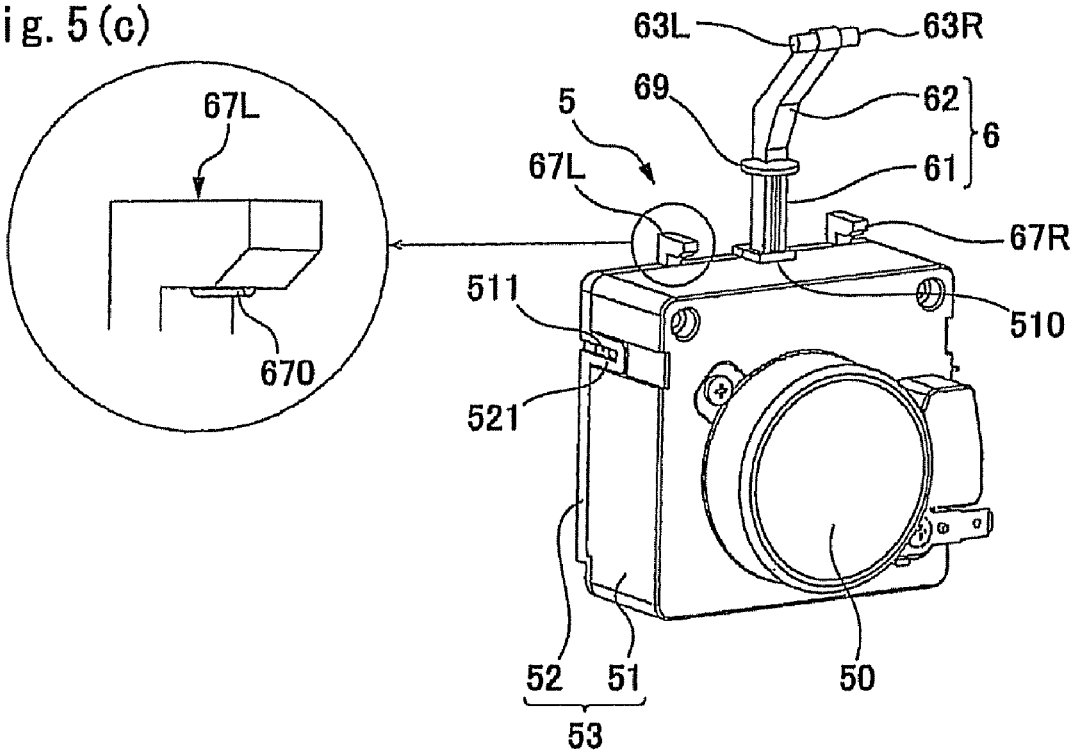

DAMPER DEVICE

CROSS REFERENCE TO RELATED APPLICATION

The present invention claims priority under 35 U.S.C. §119 to Japanese Application No. 2006-256132 filed Sep. 21, 2006, which is incorporated herein by reference.

FIELD OF THE INVENTION

An embodiment of the present invention may relate to a damper device which is provided with a baffle for opening or closing a passage for fluid.

BACKGROUND OF THE INVENTION

A damper device has been used in a refrigerator or in an air-conditioner for opening/closing a passage for fluid. The damper device includes a frame, a baffle which is turnably supported on the frame, and a drive unit for turnably driving the baffle. The passage through which fluid is passed is opened and closed by the baffle that is turned. Therefore, the above-mentioned damper device is often structured that the drive unit is connected with a turning shaft of the baffle to turnably drive the baffle (see, for example, Japanese Utility Model Laid-Open No. Sho 64-048571).

However, when the drive unit is structured so as to be connected with a turnable support part of the baffle, the baffle is required to be supported on a frame by using bearing parts. Therefore, the number of part items is increased and thus cost is increased and assembling work requires a lot of labor.

SUMMARY OF THE INVENTION

An embodiment of the present invention may advantageously provide a damper device which is capable of reducing cost and manpower for assembling by reducing the number of part items.

Thus, according to an embodiment of the present invention, there may be provided a damper device including a frame, a baffle which is turnably supported on the frame, a drive unit for turnably driving the baffle, a first and a second turnable support parts for supporting the baffle on the frame. The first and the second turnable support parts includes a shaft part which is made of resin and which is formed in one of the baffle and the frame, and a shaft hole which is formed in the other of the baffle and the frame. Further, the damper device includes a mechanical connecting part between the drive unit and the baffle, and the mechanical connecting part is structured at a position apart from a turning center axial line of the baffle, and a passage through which cold air is passed is opened and closed by the baffle.

In accordance with an embodiment of the present invention, the mechanical connecting part is structured at a position apart from a turning center axial line of the baffle and thus the baffle is not driven at a portion of the turnable support parts. Therefore, in order to turnably support the baffle on the frame, the turnable support parts are structured with the shaft part, which is made of resin and which is formed in one of the baffle and the frame, and the shaft hole which is formed in the other of the baffle and the frame. According to the structure as described above, separate bearing parts from the baffle and the frame are not required and thus number of part items is reduced and assembling can be easily and effectively performed. Further, the damper device in accordance with an embodiment of the present invention is used in a passage through which cold air is passed and thus temperature does not rise higher. Therefore, even when the shaft part is made of resin, deterioration due to temperature does not almost occur. Accordingly, since the shaft part and other portion can be made of resin, cost of the damper device can be reduced.

In accordance with an embodiment of the present invention, at least one of the shaft part and the shaft hole is elastically displaceable in an axial direction of the shaft part. According to the structure as described above, when the shaft part is to be fitted into the shaft hole, the shaft part or the shaft hole is displaced in the opposite direction to the fitting direction and thus the shaft part is fitted into the shaft hole easily. Further, after the shaft part has been fitted into the shaft hole, the shaft part or the shaft hole is going to be returned to its original position and thus a state where the shaft part has been fitted into the shaft hole is maintained.

In accordance with an embodiment of the present invention, a tapered face is formed near the shaft hole in the other of the baffle and the frame and whose thickness is increased toward the shaft hole and the shaft hole is adjacent to the tapered face. According to the structure as described above, when the shaft part is to be fitted into the shaft hole, the tip end part of the shaft part is slid on the tapered face and the shaft part or the shaft hole is displaced on an opposite side to its fitting direction and then the shaft part is fitted into the shaft hole. Accordingly, when the shaft part is to be fitted into the shaft hole, a click feeling is obtained and, after the shaft part has been fitted into the shaft hole, the shaft part is not disengaged.

In accordance with an embodiment of the present invention, a guide part is formed in the other of the baffle and the frame for sliding and guiding a side face of the shaft part to the shaft hole. According to the structure as described above, even when the position of the shaft hole cannot be observed directly, the shaft part is easily and surely fitted into the shaft hole.

In accordance with an embodiment of the present invention, the shaft part is formed in the baffle and the shaft hole is formed in the frame.

In this case, it is preferable that a plate thickness of a surrounding portion of the shaft hole is larger than a plate thickness of a peripheral portion of the surrounding portion. According to the structure as described above, a shaft hole having a sufficient depth can be formed in the frame and the shaft part is fitted into the shaft hole surely. Further, since the plate thickness of the surrounding portion of the shaft hole is set to be larger than that of the peripheral portion of the surrounding portion, the entire thickness of the frame is not required to increase.

Further, it is preferable that the shaft hole is a bottomed hole which is not penetrated through the frame. According to the structure as described above, the shaft hole is closed in the outer face of the frame. Therefore, foreign matter is prevented from entering into the shaft hole from the outside and turning of the baffle is prevented from being disturbed by the foreign matter. Accordingly, reliability of the damper device can be enhanced.

In accordance with an embodiment of the present invention, the shaft part is protruded to an outer side from a side face of the baffle, the shaft hole which is formed in the frame is opened to an inner side of the frame, and the shaft part of the baffle is fitted into the shaft hole of the frame from an inner side of the frame. According to the structure as described above, a turning support mechanism for the baffle is formed within the inside of the frame and thus the shape of an outer face of the frame can be simplified.

In this case, a side face part may be formed in a side face of the baffle to be displaceable in an axial direction of the shaft part through a slit formed in the baffle and the shaft part is formed at a tip end side of the side face part. According to the structure as described above, the shaft part can be displaced in its axial direction by utilizing the side face portion itself of the baffle and thus structure is extremely simplified.

In accordance with an embodiment of the present invention, the drive unit is provided with a housing for accommodating a driving force transmission mechanism for transmitting a driving force of a motor and an output member which is protruded from the housing and which is linearly moved to transmit the driving force from the driving force transmission mechanism to the baffle. Further, a slider part is provided at a tip end of the output member so as to be engaged with a groove part, which is formed in the baffle, to turn the baffle around the turning center axial line of the first and the second turnable support parts. According to the structure as described above, the baffle is turned by using the groove part formed in the baffle and the slider part formed in the tip end of the output member. Therefore, the turnable support part is structured with the shaft part, which is made of resin and which is formed in one of the baffle and the frame, and the shaft hole which is formed in the other of the baffle and the frame and thus assembling can be performed easily and efficiently.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5(*a*) is an explanatory view showing a method for connecting a drive unit to the baffle unit in the damper device shown in FIGS. 1(*a*) and 1(*b*), FIG. 5(*b*) is a perspective view showing the drive unit, and FIG. 5(*c*) is an explanatory perspective view showing rib-shaped projection which is formed in the drive unit.

DETAILED DESCRIPTION OF THE PREFERRED EMBODIMENTS

An embodiment of the present invention will be described below with reference to the accompanying drawings.

Figure 1:
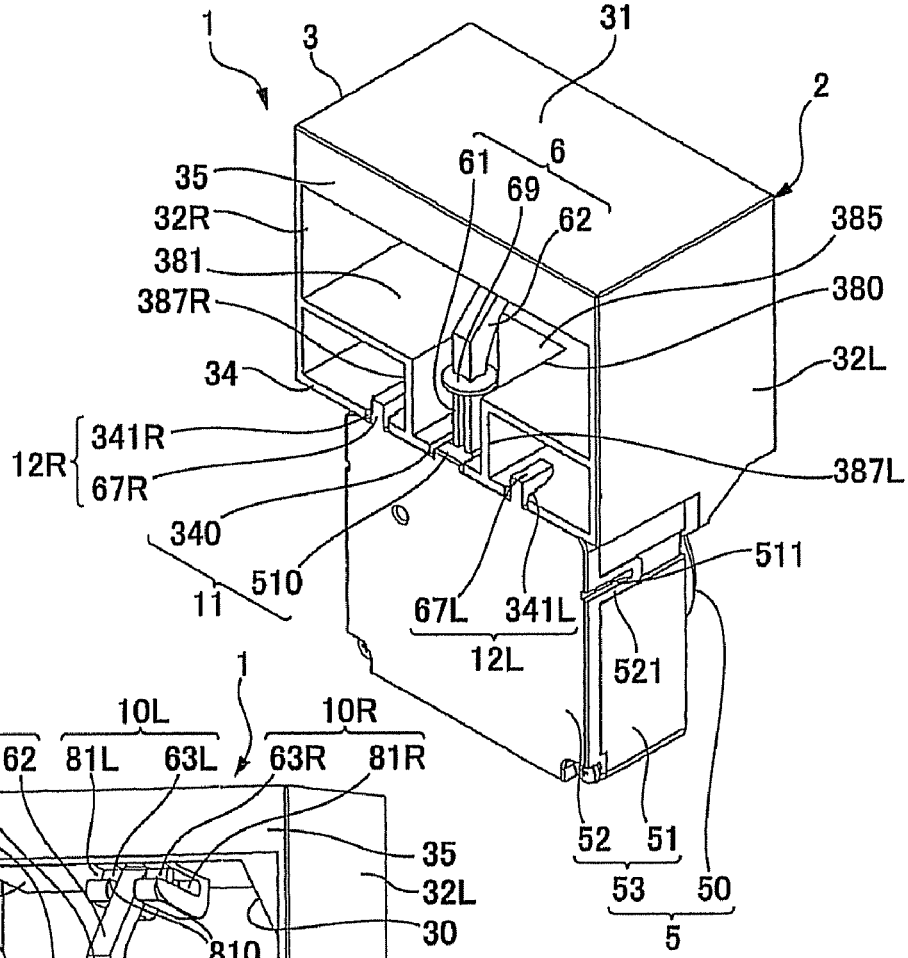
FIG. 1(*a*) is a perspective view showing a rear face side of a damper device in accordance with an embodiment of the present invention which is viewed from obliquely above, and FIG. 1(*b*) is its perspective view which is viewed from obliquely below.
Figure 1:
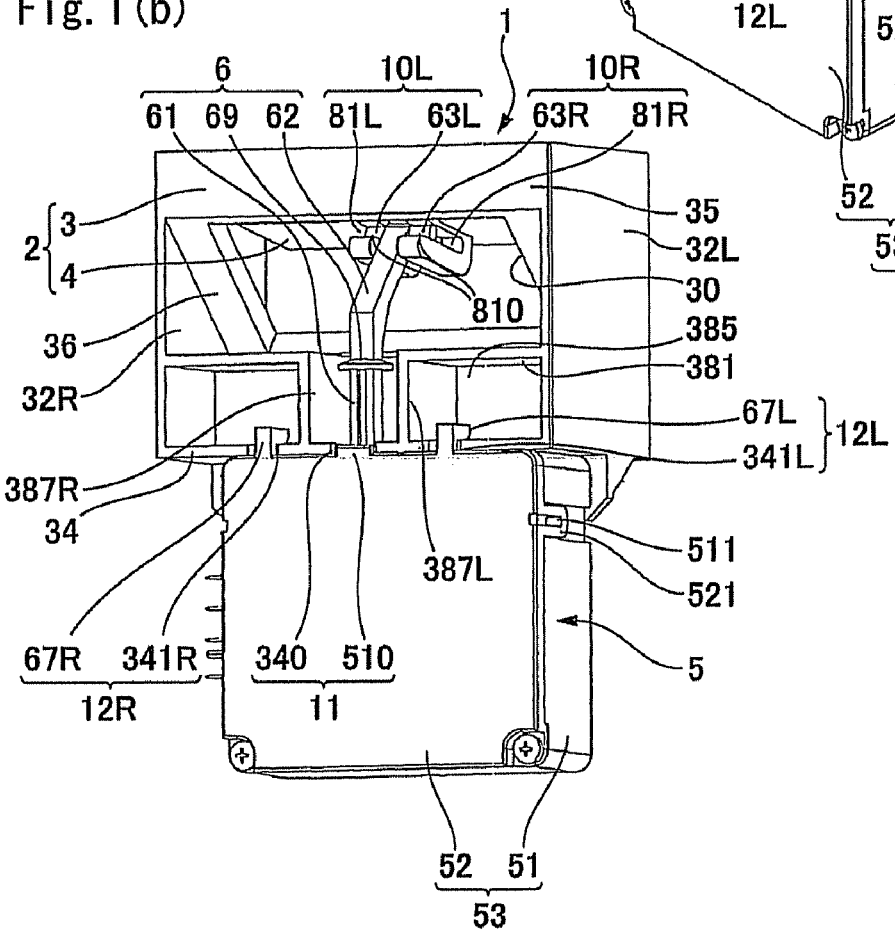
Figure 2:
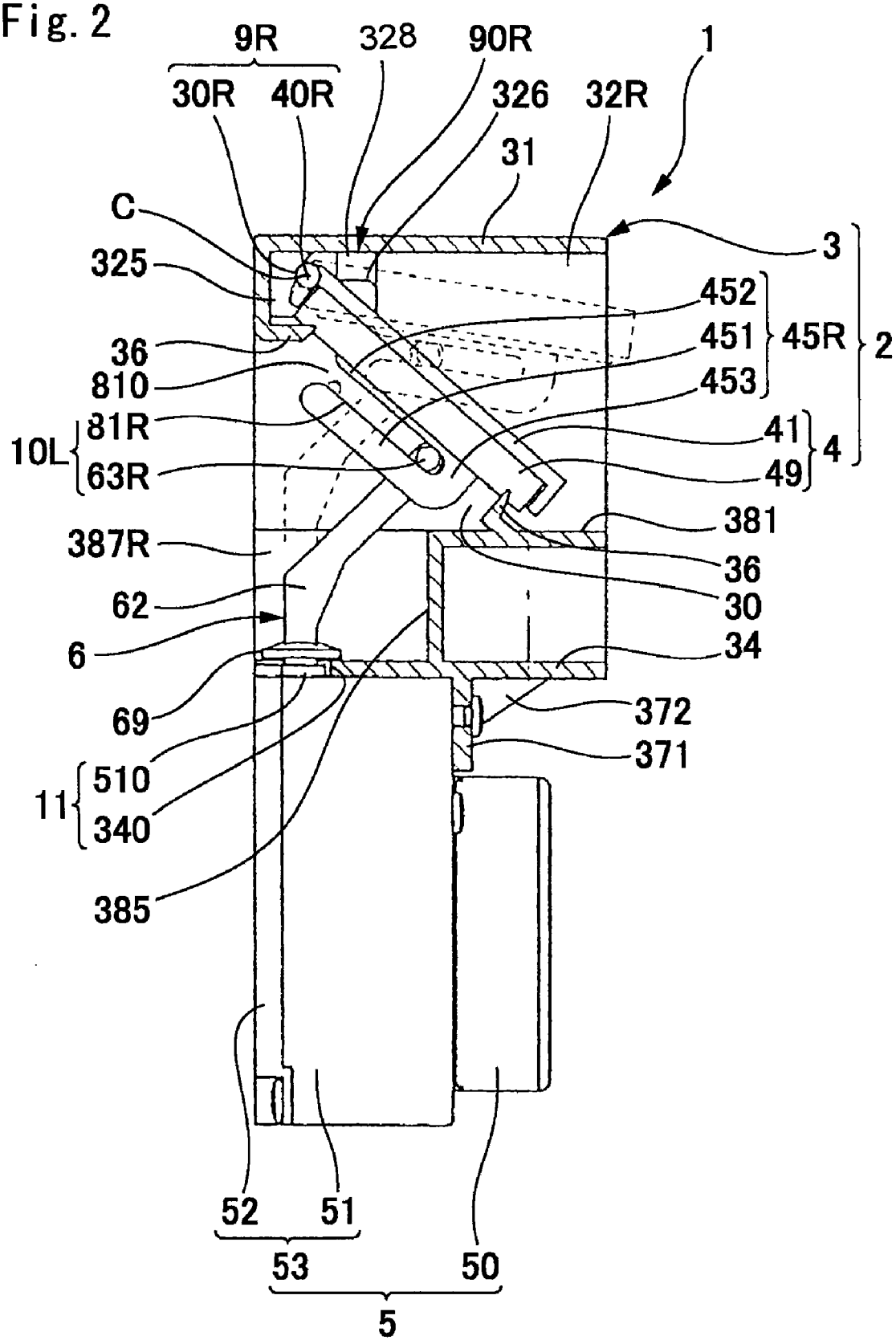
FIG. 2 is a longitudinal sectional view showing the damper device shown in FIGS. 1(*a*) and 1(*b*).
Figure 3:
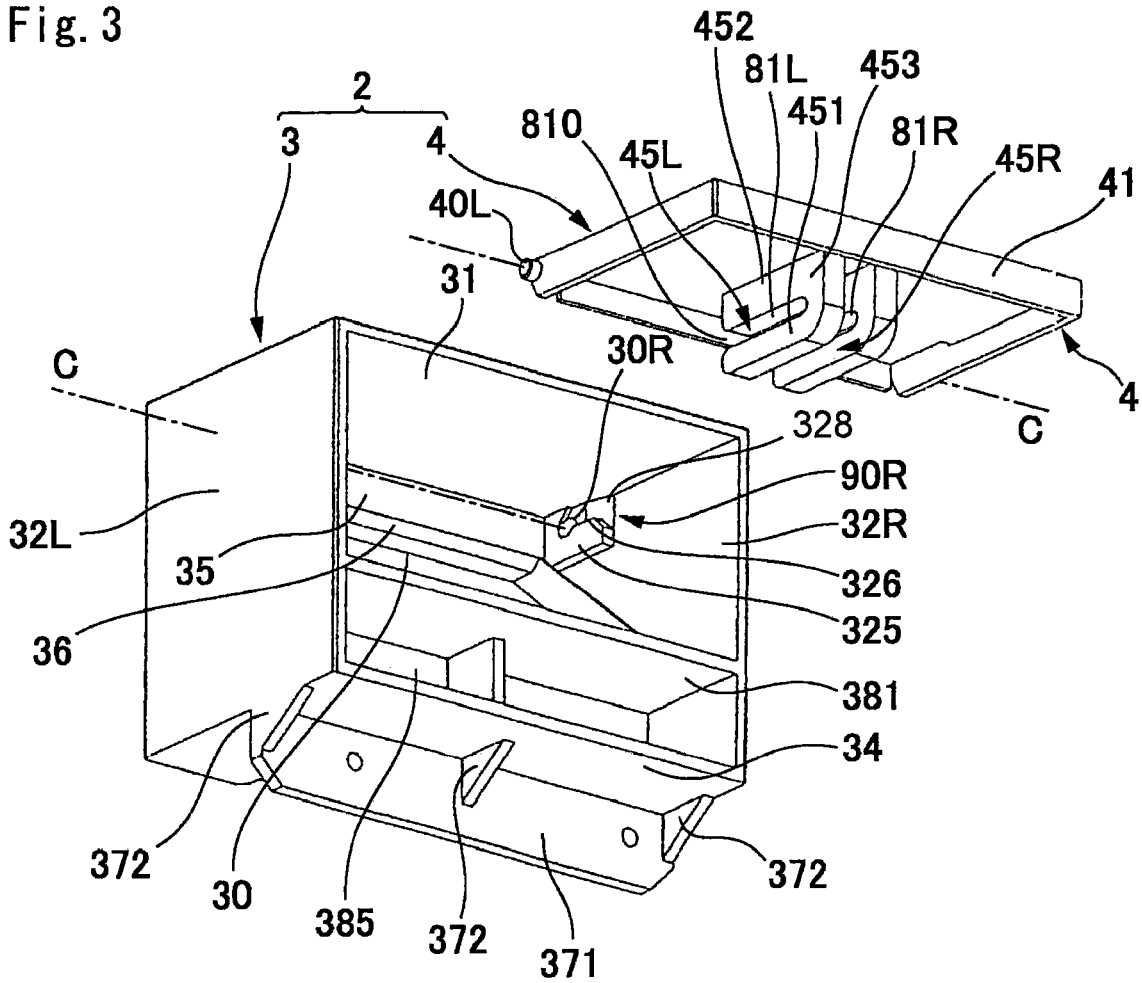
FIG. 3 is an explanatory view showing a baffle unit of the damper device shown in FIGS. 1(*a*) and 1(*b*) which is disassembled into a frame and a baffle.

FIG. 1(*a*) is a perspective view showing a rear face side of a damper device in accordance with an embodiment of the present invention which is viewed from obliquely above, and FIG. 1(*b*) is its perspective view which is viewed from obliquely below. FIG. 2 is a longitudinal sectional view showing the damper device shown in FIGS. 1(*a*) and 1(*b*). FIG. 3 is an explanatory view showing a baffle unit of the damper device shown in FIGS. 1(*a*) and 1(*b*) which is disassembled into a frame and a baffle. In FIG. 3, a buffer member is detached from the baffle.

A damper device 1 shown in FIG. 1(*a*) through FIG. 2 is a device for controlling supply of cold air to a storage chamber in a refrigerator. The damper device 1 is generally structured of a baffle unit 2 which is provided with a baffle 4 within a frame 3 and a drive unit 5 which is connected to an under face of the baffle unit 2. In the baffle unit 2, the frame 3 is formed in a case shape which is provided with a rectangular upper plate part 31, rectangular right and left side plate parts 32L and 32R, a rectangular bottom plate part 34 and a rear plate part 35. A rear end part of the bottom plate part 34 is formed with a cutout part 340, through which an output member 6 is passed as described below, at a center position in a widthwise direction of the bottom plate part 34. Cutout parts 341L and 341R with which hook parts 67L and 67R described below are engaged are formed on both sides of the cutout part 340. The frame 3 is provided in the inside of the frame 3 with a horizontal intermediate plate part 381 which faces the bottom plate part 34. The rear end side of the horizontal intermediate plate part 381 is formed with a cutout part 380, through which the output member 6 is passed as described below, at a center position in a widthwise direction of the horizontal intermediate plate part 381. The horizontal intermediate plate part 381 is connected with the bottom plate part 34 through a perpendicular intermediate plate part 385 and two perpendicular side plate parts 387L and 387R. As a result, a space through which the output member 6 is passed is formed between the two perpendicular side plate parts 387L and 387R. The perpendicular intermediate plate part 385 closes a space between the horizontal intermediate plate part 381 and the bottom plate part 34 in a front and rear direction.

An under face of the bottom plate part 34 is formed with a connecting plate part 371 which is protruded downward. An upper side of a front face of the drive unit 5 is abutted with the connecting plate part 371 and fastened to it with a screw. The connecting plate part 371 and the bottom plate part 34 are reinforced with each other by using triangular reinforcing plate parts 372.

In accordance with an embodiment of the present invention, a front part of the frame 3 is formed in a completely open state and the rear plate part 35 covers only an upper portion of a rear face part of the frame 3. Further, a rectangular frame part 36 which is formed in an obliquely upward direction is formed in the inside of the frame 3 so as to protrude on an inner side from the respective inner side faces of the rear plate part 35, the side plate parts 32L and 32R and the horizontal intermediate plate part 381. An opening part 30 of the rectangular frame part 36 is penetrated through the frame 3 in the front and rear direction. A tip end part of the rectangular frame part 36 is formed in a sharp shape toward the baffle 4.

As described above, a passage through which fluid is passed is formed within the inside of the frame 3 and the baffle 4 controls flow of fluid by opening or closing the opening part 30. In this embodiment, the baffle 4 is supported to the frame 3 on a front side of the opening part 30 (front side of the rectangular frame part 36) so as to be capable of turning around a horizontal axial line (turning center axial line "C"). Therefore, the baffle 4 is turned around the horizontal axial line to be changed to a closed position as shown by the solid line in FIG. 2 and to an open position as shown by the dotted line in FIG. 2. The baffle 4 is provided with a box-shaped baffle plate 41 made of resin and a buffer member 49 made of rubber or the like which is fixed on a rear face of the baffle plate 41. The baffle 4 is disposed such that the buffer member 49 is located on the opening part 30 side.

As shown in FIGS. 2 and 3, two arm parts 45L and 45R are formed at a roughly center area in a widthwise direction of the rear face of the baffle 4. The two arm parts 45L and 45R are extended in parallel to each other in the front and rear direction at a position that is shifted from the turning center axial line "C". The respective arm parts 45L and 45R are provided with a protruded part 453 protruding from the baffle 4 to its rear side and a rail portion 451 which is extended from the protruded part 453 in a direction crossing the turning center axial line "C" of the baffle 4 to form grooves 81L and 81R on the rear side of the baffle 4. In addition, the arm parts 45L and 45R are respectively provided with rail portions 452 which are extended in parallel to each other so as to have a certain space to the rail portion 451. These rail portions 451 and 452 are connected with each other at one end portion to be formed in a U-shape. In accordance with an embodiment, the rail portion 452 is fixed to the baffle plate 41 and the rail portion 451 is provided in a floated state from the rear face of the baffle 4.

In this embodiment, the two arm parts 45L and 45R are respectively disposed such that the U-shaped connecting part (protruded part 453) is located at a far side from the turning center axial line "C" and an open end 810 is located at a closer position to the turning center axial line "C". Therefore, the two grooves 81L and 81R are respectively formed such that one end part which is located at the closer position to the turning center axial line "C" is formed in the open end 810 in a longitudinal direction of the grooves 81L and 81R, and the other end part is closed which is located at the far side from the turning center axial line "C".

Figures 4A, 4B, 4C, 4D, 4E, 4F:
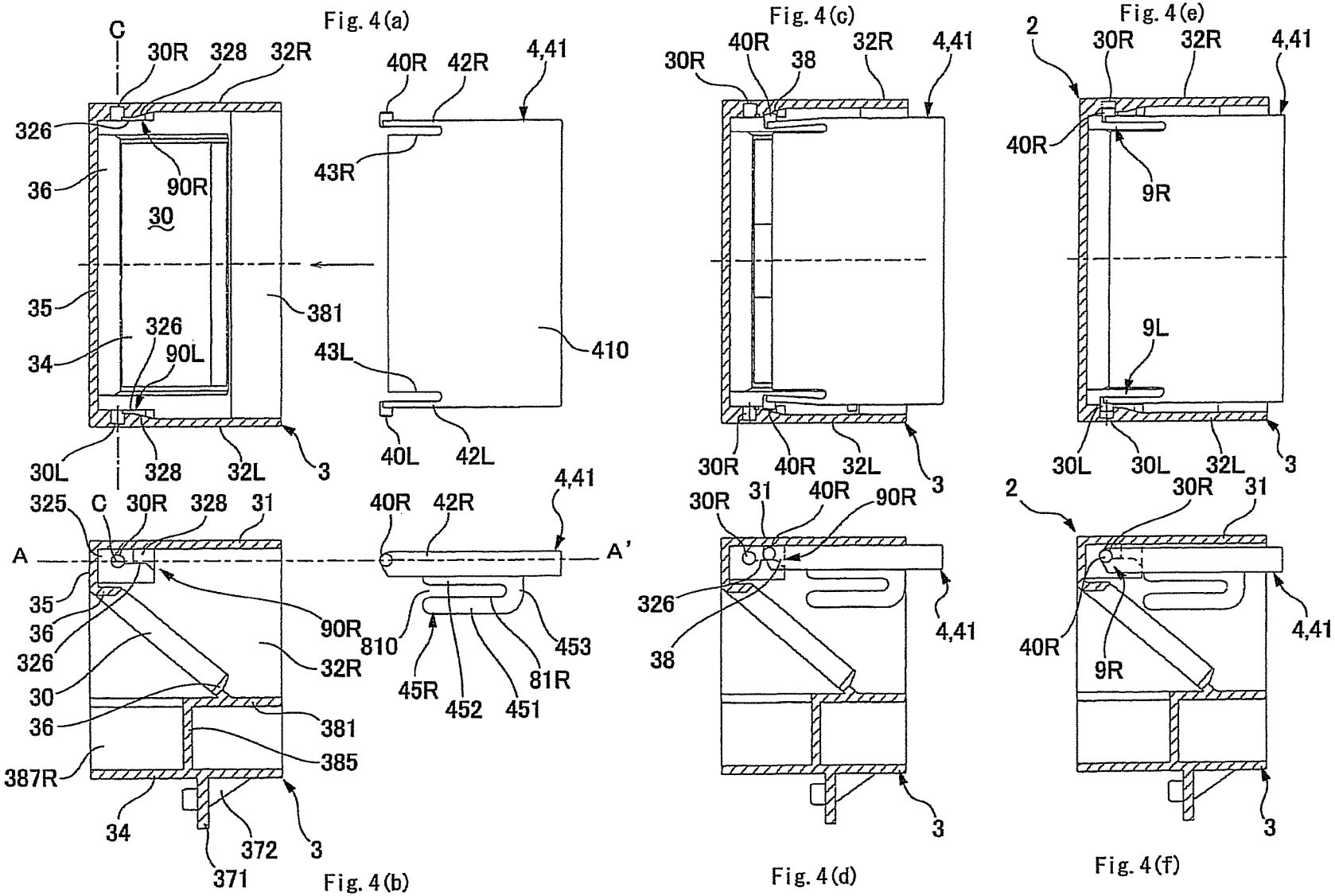
FIGS. 4(*a*) through 4(*f*) are explanatory views showing a method for attaching the baffle to the frame in the damper device shown in FIGS. 1(*a*) and 1(*b*).

FIGS. 4(*a*) through 4(*f*) are explanatory views showing a method for attaching the baffle to the frame in the damper device shown in FIGS. 1(*a*) and 1(*b*). Specifically, FIG. 4(*a*) is a transverse cross-sectional view showing the frame and the baffle, and FIG. 4(*b*) is their longitudinal sectional view. FIG. 4(*c*) is a transverse cross-sectional view showing a state that the baffle is going to be mounted on the frame and FIG. 4(*d*) is its longitudinal sectional view. FIG. 4(*e*) is a transverse cross-sectional view showing a state that the baffle has been mounted on the frame and FIG. 4(*f*) is its longitudinal sectional view. FIGS. 4(*a*), 4(*c*) and 4(*d*) correspond to a cross-sectional view which is cut by the line "A-A" in FIG. 4(*b*).

In this embodiment, in order to structure that the baffle 4 is turnably supported to the frame 3, the following structure is utilized which is described with reference to FIGS. 2 and 3 and FIGS. 4(*a*) through 4(*f*). In other words, as shown in FIGS. 2, 3 and 4(*a*), the baffle 4 is provided with cylindrical shaft parts 40L and 40R that are protruded from the respective right and left side face parts 42L and 42R on the rear end side of a baffle plate 41. On the other hand, the frame 3 is provided with shaft holes 30L and 30R which are formed at the rear end position on inner side faces of the right and left side plate parts 32L and 32R. When the right and left shaft parts 40L and 40R are respectively fitted to the right and left shaft holes 30L and 30R, a first turnable support part 9L and a second turnable support part 9R are structured.

In accordance with an embodiment of the present invention, the right and left shaft parts 40L and 40R are formed on the rear end parts of the right and left side face parts 42L and 42R of the baffle plate 41. The right and left side face parts 42L and 42R are formed so as to be partially separated from a main body portion of the baffle plate 41 by slits 43L and 43R which are extended to a midway position on a front side from its rear end portion. Therefore, the rear end parts of the right and left side face parts 42L and 42R are capable of deforming like a flat spring in the right and left direction, and the right and left shaft parts 40L and 40R are capable of displacing in an axial direction of the shaft parts 40L and 40R.

In the right and left side plate parts 32L and 32R of the frame 3, a plate thickness of a portion where the shaft holes 30L and 30R are formed is made to be larger than other portion. Therefore, the right and left shaft holes 30L and 30R are formed in a bottomed hole but they can be provided with a sufficient depth dimension. In accordance with an embodiment of the present invention, since the right and left shaft holes 30L and 30R are formed in a bottomed hole, the shaft holes 30L and 30R are opened in the inner side face of the side plate parts 32L and 32R but they are not penetrated to their outer side face.

In the right and left side plate parts 32L and 32R, surrounding portions of the shaft holes 30L and 30R are formed such that a portion other than a front side portion is formed in a platform-shaped protruded part 325. The protruded part 325 is extended in a roughly parallel manner to an under face of the upper plate part 31 to a position facing the under face of the upper plate part 31 with a predetermined gap space so that a guide wall 326 facing the under face of the upper plate part 31 is provided in the protruded part 325. Therefore, the frame 3 is formed with guide parts 90L and 90R by an inner side face (guide wall 326) of the protruded part 325 and the under face of the upper plate part 31 for sliding and guiding side faces of the shaft parts 40L and 40R when the shaft parts 40L and 40R are to be fitted to the shaft holes 30L and 30R. Further, in the right and left side plate parts 32L and 32R, a plate thickness of portions where the shaft holes 30L and 30R are formed is made larger than that of other portion. In addition, their adjacent front side portions of the shaft holes 30L and 30R are formed in a tapered face 328 whose thickness is gradually increased to the shaft holes 30L and 30R. The shaft holes 30L and 30R are opened in a face that is continuously formed at the same height position as the highest portion of the tapered face 328.

In order to assemble the baffle unit 2 by using the frame 3 and the baffle 4 which are structured as described above, as shown in FIG. 3 and FIGS. 4(*a*) and 4(*b*), the baffle 4 is inserted from a front side of the frame 3. In this case, the shaft parts 40L and 40R of the baffle 4 are slid on the under face of the upper plate part 31 of the frame 3. As a result, as shown in FIGS. 4(*c*) and 4(*d*), when the shaft parts 40L and 40R are entered into the guide parts 90L and 90R, the tip end parts of the shaft parts 40L and 40R are pushed by the tapered faces 328 of the side plate parts 32L and 32R and thus the rear end portions of the side face parts 42L and 42R are resiliently bent on the inner side. Therefore, the shaft parts 40L and 40R are moved toward the shaft holes 30L and 30R while the shaft parts 40L and 40R are displaced to the inner side. Further, the side faces of the shaft parts 40L and 40R are guided by the guide parts 90L and 90R which are formed with the guide wall 326 of the protruded part 325 and the under face of the upper plate part 31 to reach to the shaft holes 30L and 30R.

After that, as shown in FIGS. 4(*e*) and 4(*f*), when the shaft parts 40L and 40R have been reached to the shaft holes 30L and 30R, the rear end portions of the side face parts 42L and 42R are returned from the state that the rear end portions have resiliently bent to the inner side and the shaft parts 40L and 40R are displaced to the outer side. As a result, the shaft parts 40L and 40R are fitted into the shaft holes 30L and 30R and thus a first turnable support part 9L and a second turnable support part 9R are structured which turnably support the baffle 4 to the frame 3.

FIG. 5(*a*) is an explanatory view showing a method for connecting the drive unit to the baffle unit in the damper device shown in FIGS. 1(*a*) and 1(*b*), FIG. 5(*b*) is a perspective view showing the drive unit, and FIG. 5(*c*) is an explanatory perspective view showing rib-shaped projection which is formed in the drive unit.

The drive unit 5 is provided with a housing 53 which is structured of a bottomed rectangular and tubular case 51 whose upper face is abutted with the under face of the bottom plate part 34 of the baffle unit 2 and a rear end plate 52 which closes a rear opening of the case 51. A motor 50 such as an AC synchronous motor is fixed to a front face of the housing 53. A shaft-shaped output member 6 is protruded from the upper face of the housing 53. An opening part (not shown) is formed at a rear end part of the upper face of the housing 53 for protruding the output member 6 from the housing 53. A plurality of engaging plate parts 521 is formed in the rear end plate 52 for fitting the rear end plate 52 to the case 51, and holes of the engaging plate parts 521 are engaged with projections 511 which are formed on the side face of the case 51.

The drive unit 5 in this embodiment is structured of a driving force transmission mechanism (not shown) for transmitting a driving force from a motor to the output member 6 within the inside of the housing 53. In this embodiment, the driving force transmission mechanism is provided with a speed reducing gear train through which rotation of the motor is transmitted while being decelerated, a rotation-linear motion converting mechanism by using a rack and a pinion, and the like. The output member 6 is advanced or retreated in an axial direction by rotation of the motor.

The output member 6 is provided with a bar-shaped portion 61 which is straightly protruded upward from the housing 53 and a forward inclined portion 62 which is further extended upward from the bar-shaped portion 61 and then obliquely bent to a front side. The tip end parts of the forward inclined portions 62 are formed with two round bar-shaped slider parts 63L and 63R which are projected on both the right and left sides. The slider parts 63L and 63R are respectively fitted into the grooves 81L and 81R to structure slide mechanisms 10L and 10R (mechanical connected portion between the baffle 4 and the drive unit 5). The slide mechanisms 10L and 10R are located at inner side positions in a widthwise direction of the first turnable support part 9L and the second turnable support part 9R which are described with reference to FIG. 4(*e*) and located at positions apart from the turning center axial line "C".

A boundary portion of the output member 6 between the bar-shaped portion 61 and the forward inclined portion 62 is formed with a disk-shaped flange part 69 for preventing drops of water or the like from flowing from a tip end portion of the output member 6 to its bar-shaped portion 61 to prevent the drops of water or the like from entering into the housing 63.

In order to connect the drive unit 5 structured as described above to the under surface of the baffle unit 2, as shown in FIG. 5(*a*), the slider parts 63L and 63R which are formed at the tip end part of the output member 6 are inserted into the inner sides of the grooves 81L and 81R from the open end 810 sides of the grooves 81L and 81R to structure the slide mechanisms 10L and 10R.

Next, the drive unit 5 is turned downward around the slider parts 63L and 63R and the housing 53 of the drive unit 5 is set to be at a lower position of the frame 3. After that, a connecting plate part 371 of the frame 3 and a front face of the housing 53 of the drive unit 5 is fixed to each other with screws.

In order to connect the drive unit 5 with the baffle unit 2 in a connecting method as described above, in this embodiment, as described below with reference to FIGS. 1(*a*), 1(*b*), FIG. 2 and FIGS. 5(*a*) through 5(*c*), a positioning mechanism 11 for determining their relative position by engaging with each other and connection mechanisms 12L and 12R for combining the frame 3 with the drive unit 5 by fitting one to the other are structured between the drive unit 5 and the frame 3 of the baffle unit 2.

In this embodiment, as shown in FIGS. 1(*a*), 1(*b*), FIG. 2 and FIG. 5(*b*), in order to structure the positioning mechanism 11, a rectangular seat part 510 is protruded on the upper face of the housing 53 of the drive unit 5 where an base end portion of the output member 6 is protruded. On the other hand, a rear end portion of the bottom plate part 34 of the frame 3 of the baffle unit 2 is formed with a rectangular cut-out part 340 having substantially same dimension as the seat part 510. Therefore, when the drive unit 5 and the baffle unit 2 are to be connected with each other, the seat part 510 is fitted into the cut-out part 340 and thus positioning between the drive unit 5 and the baffle unit 2 is performed. Accordingly, in order to assemble the damper device 1, after the frame 3 and the drive unit 5 have been separately assembled, the frame 3 and the drive unit 5 can be easily and surely connected with each other with a high degree of positional accuracy. Further, the positioning mechanism 11 is structured in which the cut-out part 340 to which the seat part 510 is fitted is formed in the rear end portion of the bottom plate part 34. Therefore, the seat part 510 is easily fitted to the bottom plate part 34 and a cut-out portion of the bottom plate part 34 is required to be small.

Further, in this embodiment, as shown in FIGS. 1(*a*), 1(*b*), FIG. 2 and FIG. 5(*b*), the connection mechanisms 12L and 12R are structured in which an upper face (upper end part of the rear end plate 52) of the housing 53 of the drive unit 5 is formed with hook parts 67L and 67R which are protruded upward with a predetermined dimension from the upper face of the housing 53 and then bent forward. A gap space whose width is a little smaller than that of the bottom plate part 34 of the frame 3 is formed between the tip end parts of the hook parts 67L and 67R and the upper face of the housing 53. Further, cut-out parts 341L and 341R to which the hook parts 67L and 67R are fitted are formed in the bottom plate part 34 of the frame 3. Therefore, when the drive unit 5 and the baffle unit 2 are to be connected with each other, the bottom plate part 34 of the frame 3 is inserted between the tip end parts of the hook parts 67L and 67R and the upper face of the housing 53 so that the hook parts 67L and 67R are fitted to the cut-out parts 341L and 341R. As a result, the hook parts 67L and 67R are resiliently bent upward and a state where the bottom plate part 34 of the frame 3 is inserted between the tip end parts of the hook parts 67L and 67R and the upper face of the housing 53 is maintained by shape return forces of the hook parts 67L and 67R. Therefore, when the damper device 1 is to be assembled, a lot of part items and man-hours are not required to connect the drive unit 5 with the frame 3.

Further, in this embodiment, as shown in FIG. 5(*c*), under faces of the tip end parts of the hook parts 67L and 67R are formed with a rib-shaped projection 670 which is extended in a fitting direction of the bottom plate part 34 of the frame 3. Therefore, when the bottom plate part 34 of the frame 3 is inserted between the tip end parts of the hook parts 67L and 67R and the upper face of the housing 53, the rib-shaped projections 670 are pressed so as to be deformed in a direction perpendicular to the fitting direction and thus the drive unit 5 and the baffle unit 2 are firmly connected with each other.

In a state of the damper device 1 as shown by the solid line in FIG. 2, the output member 6 has been moved downward to be located at a closing position where an opening part 30 (passage of cold air) is closed by the baffle 4. In this state, the slider parts 63L and 63R are located at the most apart position from the turning center axial line "C" in the grooves 81L and 81R. When the output member 6 is moved upward from this state, the rail portion 452 of the baffle 4 is pushed upward and turned around the turning center axial line "C" and thus the baffle 4 is moved to an open position as shown by the dotted line in FIG. 2. In this state, the baffle 4 causes the opening part 30 to open and the slider parts 63L and 63R have been moved along the grooves 81L and 81R in a direction coming near the turning center axial line "C".

When the output member 6 is moved down from above-mentioned state, the arm parts 45L and 45R (rail portion) are pushed downward and the baffle 4 is turned around the turning center axial line "C" to be returned to the closed position as shown by the solid line in FIG. 2. In this case, the slider parts 63L and 63R are moved along the grooves 81L and 81R to positions apart from the turning center axial line "C".

As described above, in this embodiment, since the baffle 4 is turned by advancing or retreating operation of the output member 6, structure can be simplified in comparison with a case that the baffle 4 is directly driven to turn. Further, since the baffle 4 is turned by advancing and retreating operation of the output member 6, the mechanical connection part between the drive unit 5 and the baffle 4 may be structured at a position apart from the turning center axial line "C" of the baffle 4. Therefore, the baffle 4 is not required to be driven at the turnable support parts 9L and 9R. Accordingly, in order to turnably support the baffle 4 on the frame 3, the turnable support parts 9L and 9R may be structured with the shaft parts 40L and 40R which are formed in the baffle 4 and the shaft holes 30L and 30R which are formed in the frame 3. According to the structure as described above, separate bearing parts from the baffle 4 and the frame 3 are not required. Therefore, number of parts is reduced and assembling can be easily and effectively performed.

Further, the damper device 1 in accordance with an embodiment of the present invention is used in a passage through which cold air is passed and thus temperature does not rise higher. Therefore, even when the entire baffle plate 41 including the shaft parts 40L and 40R are made of resin, or even when the frame 3 is made of resin, deterioration due to high temperature does not almost occur and thus cost of the damper device 1 can be reduced by an amount because resin is used.

In addition, the shaft parts 40L and 40R are elastically displaceable in their axial directions. Therefore, when the shaft parts 40L and 40R are fitted into the shaft holes 30L and 30R, the shaft parts 40L and 40R are displaced in an opposite direction to the fitting direction and thus the shaft parts 40L and 40R are fitted into the shaft holes 30L and 30R easily. Further, after the shaft parts 40L and 40R have been fitted into the shaft holes 30L and 30R, the shaft parts 40L and 40R or the shaft holes 30L and 30R are going to be returned to their original positions. Therefore, a state where the shaft parts 40L and 40R have been fitted into the shaft holes 30L and 30R are maintained. Moreover, when the shaft parts 40L and 40R are to be fitted into the shaft holes 30L and 30R, the tip end parts of the shaft parts 40L and 40R are slid on the tapered faces 328. Therefore, the shaft parts 40L and 40R have been displaced on an opposite side to their fitting directions and then the shaft parts 40L and 40R are rapidly displaced in the fitting direction to the shaft holes 30L and 30R and fitted into the shaft holes 30L and 30R. Accordingly, when the shaft parts 40L and 40R are to be fitted into the shaft holes 30L and 30R, a click feeling is obtained and, after the shaft parts 40L and 40R have been fitted into the shaft holes 30L and 30R, the shaft parts 40L and 40R are not disengaged.

In addition, in this embodiment, the frame 3 is formed with guide parts 90L and 90R for sliding and guiding the side faces of the shaft parts 40L and 40R to the shaft holes 30L and 30R. Therefore, even when the positions of the shaft holes 30L and 30R cannot be observed directly, the shaft parts 40L and 40R are easily an surely fitted into the shaft holes 30L and 30R.

Further, plate thickness of the surrounding portions of the shaft holes 30L and 30R in the frame 3 is set to be larger than that of other portions. Therefore, when the shaft holes 30L and 30R are to be formed in the frame 3, the shaft holes 30L and 30R having a sufficient depth can be formed and thus a structure in which the shaft parts 40L and 40R are surely fitted into the shaft holes 30L and 30R can be realized. Further, only a plate thickness of the surrounding portions of the shaft holes 30L and 30R is set to be larger than that of other portion of the frame 3 and thus the entire thickness of the frame 3 is not required to increase. Moreover, the shaft holes 30L and 30R are formed of a bottomed hole which is not penetrated through to an outer side of the frame 3, and the shaft holes 30L and 30R are closed by the outer face of the frame 3. Therefore, foreign matters are prevented from entering into the shaft holes 30L and 30R from the outside and turning of the baffle 4 is prevented from being disturbed by the foreign matters. Accordingly, reliability of the damper device 1 can be enhanced.

Further, in this embodiment, in order to adopt a structure for converting an advancing and retreating operation of the output member 6 to a turning operation of the baffle 4, the slider parts 63L and 63R are disposed to be movable within the grooves 81L and 81R and one end portions of the grooves 81L and 81R are formed as an open end 810. Therefore, when the damper device 1 is to be assembled, the slider parts 63L and 63R are fitted from the open ends of the grooves 81L and 81R and thus assembling work can be easily and efficiently performed.

In addition, in order to form one end portions of the grooves 81L and 81R as the open end 810, the end parts of the grooves 81L and 81R which are located near the turning center axial line "C" are formed as the open end 810 and the end parts which are located at far side of the turning center axial line "C" are closed. Therefore, when the baffle 4 is moved from the open position as shown by the dotted line to the closed position as shown by the solid line in FIG. 2 and the buffer member 49 is pressed to the tip end part of the rectangular frame part 36, a large force is applied to the arm parts 45L and 45R (rail portion 451). However, at this time, the slider parts 63L and 63R are located at the closed end parts of the grooves 81L and 81R and their strengths are large. Accordingly, deformation of the arm parts 45L and 45R (rail portion) can be prevented.

In the embodiment described above, in the turnable support parts of the baffle 4, the shaft parts 40L and 40R are elastically displaceable in the axial directions of the shaft parts 40L and 40R. However, for example, the shaft holes 30L and 30R may be elastically displaceable in the axial directions of the shaft parts 40L and 40R by utilizing elastic deformation of the side plate parts 32L and 32R. Alternatively, both of the shaft parts 40L and 40R and the shaft holes 30L and 30R may be structured so as to be elastically displaceable in the axial direction of the shaft parts 40L and 40R.

In the embodiment described above, in order to structure the turnable support parts 9L and 9R of the baffle 4, the shaft parts 40L and 40R are formed in the baffle 4 and the shaft holes 30L and 30R are formed in the frame 3. However, the shaft parts 40L and 40R may be formed in the frame 3 and the shaft holes 30L and 30R may be formed in the baffle 4.

In the embodiment described above, the grooves 81L and 81R are formed in the baffle 4 and the slider parts 63L and 63R are formed in the output member 6 to structure the mechanical connecting portion between the baffle 4 and the drive unit 5. However, it may be structured such that the grooves 81L and 81R are formed in the output member 6 and the slider parts 63L and 63R are formed in the baffle 4. In this case, the former structure can be simplified. In other words, the baffle 4 is originally formed in a flat plate shape and thus there is a space for forming the grooves 81L and 81R originally. Therefore, the structure can be simplified in comparison with a case that the grooves 81L and 81R are formed in the output member 6.

In the embodiment described above, the slide mechanisms 10L and 10R are formed on the abutting face side of the baffle 4 with the periphery of the opening part 30 when the opening part 30 is closed. However, the present invention may be applied to a damper device in which the slide mechanisms 10L and 10R are structured on an opposite side to the abutting face with the opening part 30 when the opening part 30 is closed.

In the embodiment described above, in order to form one end portions of the grooves 81L and 81R as the open end 810, the one end portions of the grooves 81L and 81R which are located near the turning center axial line "C" are formed as the open end 810 and the other end portions which are located far from the turning center axial line "C" are formed as the closed end. However, according to an operating condition of the baffle 4, it may be structured that the end portions of the grooves 81L and 81R which are located far from the turning center axial line "C" are formed as the open end 810 and the other end portions which are located near the turning center axial line "C" are formed as the closed end.

In the embodiment described above, the one end portions of the grooves 81L and 81R are formed as the open end 810 but both end portions of the grooves 81L and 81R may be formed as the open end 810. For example, it may be structured that rail portions are disposed on both sides of the slider parts 63L and 63R in a parallel and lifted state and outer sides of the rail portions are connected with the baffle plate 41.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A damper device comprising:

a frame;

a baffle which is turnably supported on the frame;

a drive unit for turnably driving the baffle;

a first and a second turnable support parts for supporting the baffle on the frame comprising:

a shaft part made of resin which is formed in one of the baffle and the frame; and a shaft hole which is formed in the other of the baffle and the frame; and a mechanical connecting part between the drive unit and the baffle which is structured at a position apart from a turning center axial line of the baffle;

wherein a passage through which cold air is passed is structured to be opened and closed by the baffle;

wherein a tapered face whose thickness is increased toward the shaft hole is formed near the shaft hole in the other of the baffle and the frame so that the shaft hole is adjacent to the tapered face; and wherein at least one of the shaft part and the shaft hole is elastically displaceable in an axial direction of the shaft part.

2. The damper device according to claim 1, further comprising a guide part which is formed in the other of the baffle and the frame for sliding and guiding a side face of the shaft part to the shaft hole.

3. A damper device comprising:

a frame;

a baffle which is turnably supported on the frame;

a drive unit for turnably driving the baffle;

a first and a second turnable support parts for supporting the baffle on the frame comprising:

a shaft part made of resin which is formed in the baffle; and a shaft hole which is formed in the frame; and a mechanical connecting part between the drive unit and the baffle which is structured at a position apart from a turning center axial line of the baffle;

wherein a passage through which cold air is passed is structured to be opened and closed by the baffle;

wherein a side face part is formed in a side face of the baffle to be displaceable in an axial direction of the shaft part through a slit formed in the baffle;

wherein the shaft part is formed at a tip end side of the side face part and protruded to an outer side from the side face of the baffle, the shaft hole is opened to an inner side of the frame, and the shaft part of the baffle is fitted into the shaft hole of the frame from an inner side of the frame.

4. The damper device according to claim 3, wherein a plate thickness of a surrounding portion of the shaft hole of the frame is larger than a plate thickness of a peripheral portion of the surrounding portion.

5. The damper device according to claim 4, wherein the shaft hole is a bottomed hole which is not penetrated through the frame.

6. The damper device according to claim 3, further comprising a guide part which is formed in the frame for sliding and guiding a side face of the shaft part to the shaft hole.

7. The damper device according to claim 3, wherein the shaft hole is a bottomed hole which is not penetrated through the frame.

8. The damper device according to claim 1, further comprising a housing which is provided in the drive unit for accommodating a driving force transmission mechanism for transmitting a driving force of a motor;

an output member which is protruded from the housing and which is linearly moved to transmit the driving force from the driving force transmission mechanism to the baffle; and a slider part which is provided at a tip end of the output member and engaged with a groove part formed in the baffle to turn the baffle around the turning center axial line of the first and the second turnable support parts.

9. The damper device according to claim 3, further comprising a housing which is provided in the drive unit for accommodating a driving force transmission mechanism for transmitting a driving force of a motor;

an output member which is protruded from the housing and which is linearly moved to transmit the driving force from the driving force transmission mechanism to the baffle; and a slider part which is provided at a tip end of the output member and engaged with a groove part formed in the baffle to turn the baffle around the turning center axial line of the first and the second turnable support parts.

* * * * *